US007032246B1

(12) United States Patent
LeMire

(10) Patent No.: US 7,032,246 B1
(45) Date of Patent: Apr. 25, 2006

(54) REVERSIBLE SHIN GUARD

(75) Inventor: Laura LeMire, Catonsville, MD (US)

(73) Assignee: STX, LLC, Baltimore, MD (US)

( * ) Notice: Subject to any disclaimer, the term of this patent is extended or adjusted under 35 U.S.C. 154(b) by 209 days.

(21) Appl. No.: 10/684,494

(22) Filed: Oct. 15, 2003

(51) Int. Cl.
*A41D 13/00* (2006.01)

(52) U.S. Cl. ..... 2/22

(58) Field of Classification Search ..... 2/410, 2/421, 425, 411, 414, 413, 417, 181, 418, 2/205, 423, 171, 412, 209.3, 209.4, 209.7, 2/183, DIG. 11, 22, 24, 62
See application file for complete search history.

(56) References Cited

U.S. PATENT DOCUMENTS 4,277,848 A * 7/1981 Boehland ..... 2/115
4,344,189 A * 8/1982 Futere et al. ..... 2/16
5,395,400 A * 3/1995 Stafford et al. ..... 607/109
5,644,793 A * 7/1997 Lahaussois et al. ..... 2/59
6,182,291 B1 * 2/2001 Garvey ..... 2/102
6,435,194 B1 * 8/2002 Babay ..... 132/275
6,438,761 B1 * 8/2002 McGarrity ..... 2/410

* cited by examiner

*Primary Examiner*—Tejash Patel
(74) *Attorney, Agent, or Firm*—Pillsbury Winthrop Shaw Pittman LLP

(57) ABSTRACT

A shin guard is disclosed having a protective pad enclosed by two pieces of fabric, one piece of a first color and one piece of a second color, and a sleeve portion having first and second colors. The shin guard is reversible such that in a first configuration the shin guard has substantially the first color on an exterior of the guard and in a second configuration the shin guard has substantially the second color on the exterior of the shin guard. In another embodiment, the pad is, disposed between an exterior sleeve of a first color and an interior sleeve of a second color different from the first color.

13 Claims, 3 Drawing Sheets

REVERSIBLE SHIN GUARD

BACKGROUND

1. Field of the Invention

The present invention relates generally to protective equipment for use in, for example, athletics. More specifically, the present invention relates to a reversible shin guard having a first outwardly facing color and a second inwardly facing color, whereby the guard may be turned inside out so that the second color faces outwardly.

2. Background of the Invention

Protective athletic equipment is commonly used to protect portions of the body from impact encountered during the normal course of an athletic activity, for example, due to impact with a ball, other players and their equipment, and/or the playing surface. Knee pads, elbow pads, and shin guards/pads are well known in the field and provide flexible padding to be worn over portions of the body that need additional protection.

In sports such as field hockey, lacrosse, and soccer, teams often have differently-colored home and away uniforms, which can each have their own matching set of pads. In addition, the rules of some sports require matching protective equipment such that the need for multiple pad colors is not just preferred, it is mandatory. It would be desirable to have a single set of pads that could be worn with both sets of uniforms, thus reducing equipment costs and allowing for reduced space for storing equipment.

BRIEF SUMMARY OF THE INVENTION

According to one aspect, a protective guard is disclosed having a protective pad enclosed by two pieces of fabric, one piece of a first color and one piece of a second color, and a sleeve portion having first and second colors such that in a first configuration the protective guard has substantially the first color on an exterior of the guard and in a second configuration the protective guard has substantially the second color on the exterior of the protective guard.

According to another aspect, a protective guard is disclosed having an interior sleeve of a first color and an exterior sleeve of a second color. The interior and exterior sleeves are configured such that a pocket is created between the two sleeves. A pad is disposed in the pocket between the two sleeves. The protective guard is reversible between a first configuration in which the interior sleeve faces inwardly and a second configuration in which the interior sleeve faces outwardly.

DETAILED DESCRIPTION OF THE INVENTION

Figure 1:
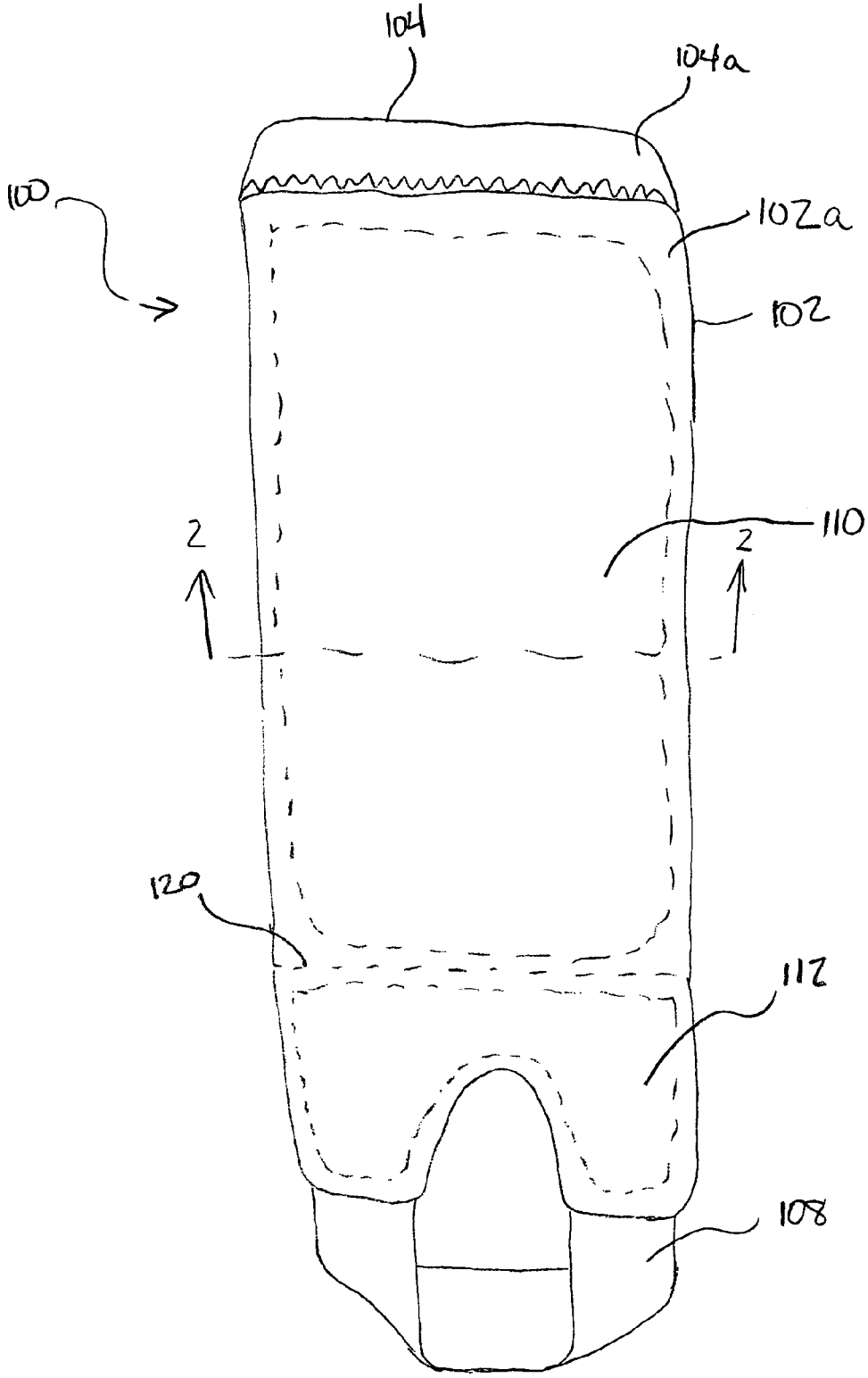
FIG. 1 is a schematic diagram that shows a front view of an exemplary shin guard according to an embodiment of the present invention.

As shown in FIG. 1, a reversible shin guard 100 is disclosed having a pad cover 102, an upper elastic band portion 104, a rear sleeve 106 (see FIG. 2), a stirrup 108 to be fitted around the foot of a user, and pads 110 and 112. Pads 110 and 112 may also be replaced by a single pad or may consist of more than two pads. Although the description herein refers to a shin guard, the invention is not intended to be limited only to shin guards. The concepts disclosed herein may be applied for example, to knee pads, elbow pads, or any other pad for which a reversible configuration would be desirable.

First pad cover 102 may be made of a suitable fabric for enclosing pads 110 and 112 and allowing the pads to be free-floating within the enclosure created between pieces 102*a* and 102*b* (see FIG. 2) of cover 102. A seam 120 is shown between pads 110 and 112 to separate the two pads from each other and also to allow for a flexible joint along seam 120. This configuration allows pad 112 to rest over a top portion of a user's foot and protect the user's ankle. Elastic stirrup 108 may be positioned under the user's foot to assist in holding shin guard 100 in place.

Although FIG. 1 shows two pads 110 and 112 separated by seam 120, an alternative embodiment of the present invention uses a single pad for pads 110 and 112 without a seam. In this embodiment, the single pad could be constructed to bend in the area of seam 120, for example, by being notched or scored in that area.

At the top of guard 100, elastic band 104 is also made of two pieces 104*a* and 104*b* (not shown) to allow for substantially all of shin guard 100 to maintain its reversible nature. Elastic band 104 may also assist in holding the top portion of guard 100 in place. It may also be possible for pieces 104*a* and 104*b* to be reversed from the configuration of the rest of the pad so that band 104 provides a contrasting trim color as opposed to being the same color as the rest of the pad. In addition, band 104 may be made of a single color that may be different from the rest of guard 100 entirely.

Figure 2:
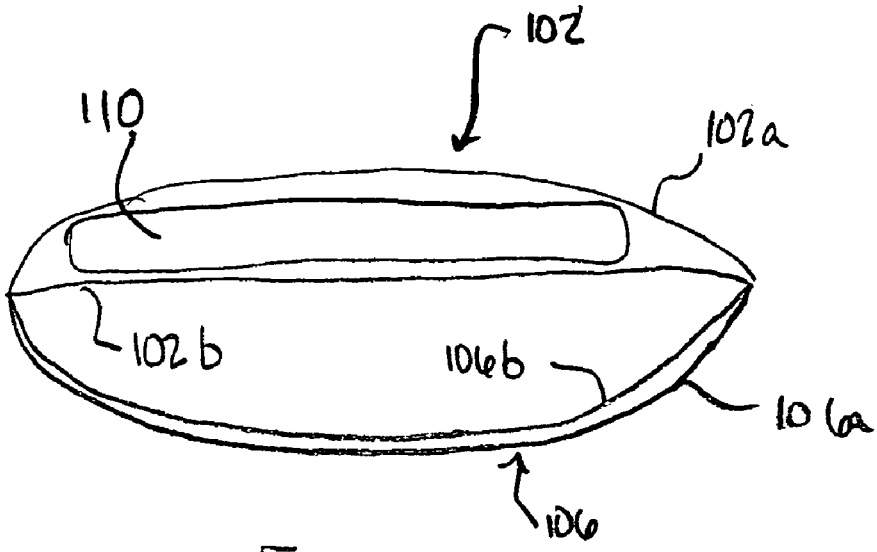
FIG. 2 is a schematic diagram that shows a cross-sectional view of the shin guard of FIG. 1 at line 2—2.

As seen in FIG. 2, which is a cross-sectional view through the shorter dimension of guard 100, pad cover 102 comprises two pieces 102*a* and 102*b*. To allow for guard 100 to be reversible, piece 102*a* may be a first color and piece 102*b* may be a second color. The two pieces 102*a* and 102*b* are affixed to one another, for example by sewing a seam around the edges, to enclose pads 110 and 112. By having the two pieces of different colors, shin guard 100 may be turned inside out. The two colors may be configured so that they match home and away uniforms or any other useful configuration of two colors.

Sleeve portion 106 is shown having two pieces 106*a* and 106*b*. As with pad cover 102, sleeve pieces 106*a* and 106*b* are of different colors and are configured so that when shin guard 100 is in a first configuration, portions 102*a* and 106*a*, each of the same first color, face outwardly so that shin guard 100 has substantially the first color facing outwardly. Pieces 102*b* and 106*b*, each of the same second color, face inwardly in this configuration and are substantially unseen when guard 100 is in the first configuration. When desired, a user may turn shin guard 100 inside out thus changing from the first configuration to a second configuration in which pieces 102*b* and 106*b* face outwardly and shin guard 100 has substantially the second color facing outwardly.

In addition to allowing for the pad to be reversible, this configuration has the added benefit of allowing air to pass through the fabric portions of the pad. Unlike protective pads made of neoprene or other non-breathable materials, shin guard 100 may be constructed of breathable fabrics. Such fabrics allow air to pass through to the user's skin and also aid in wicking moisture, such as perspiration, away from the user. Protective pads made of neoprene and other similar materials do not offer such an advantage and often result in a buildup of perspiration between the non-porous guard and the user. In addition to being uncomfortable, this build-up may also lead to rashes and other undesirable skin irritations.

Figure 3:
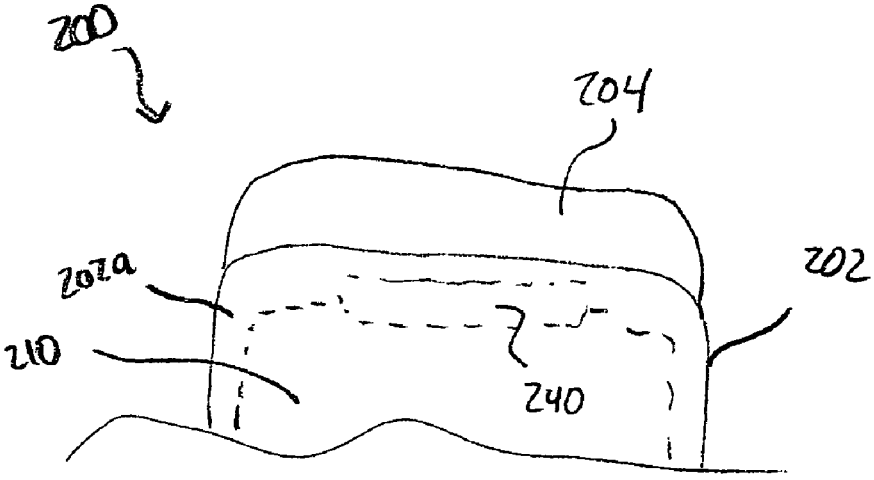
FIG. 3 is a schematic diagram that shows a partial front view of an exemplary shin guard, according to a second embodiment of the present invention.

FIG. 3 illustrates an alternative embodiment of an exemplary shin guard 200. In most respects, shin guard 200 is the same as shin guard 100. Instead of having a solid seam all the way around the top portion of sleeve cover 202, however, piece 202*a* is affixed to piece 202*b* (not shown) by a hook and loop fastener 240 (e.g. a piece of Velcro™). Any other suitable fastening device may be used in place of fastener 240, for example, snaps, buttons, clips, etc. By using a re-fastenable opening at the top of pad cover 202, pad 210 may be removed to allow for cleaning or replacement.

Figure 4:
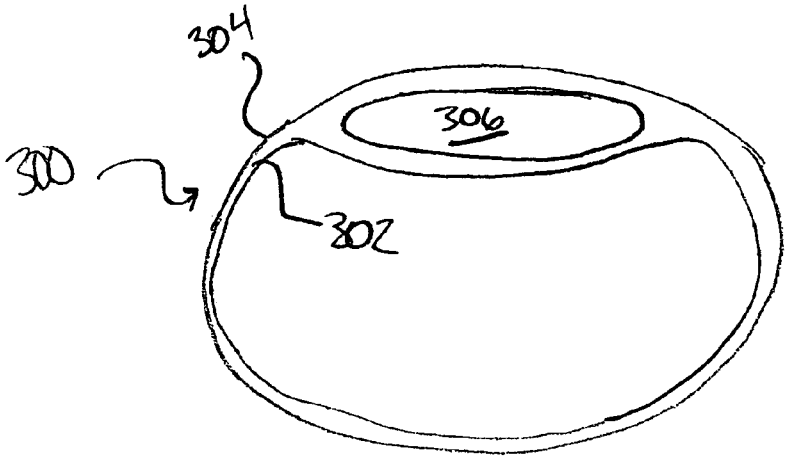
FIG. 4 is a schematic diagram that shows a cross-sectional view of an exemplary shin guard according to a third embodiment of the present invention.

FIG. 4 illustrates a cross-sectional view of a third embodiment of an exemplary shin guard 300. According to this embodiment, guard 300 comprises a first inner sleeve 302 and a second outer sleeve 304. Pad 306 is sandwiched between inner sleeve 302 and outer sleeve 304 and the two sleeves 302 and 304 are preferably of a different color. Sleeves 302 and 304 can be joined continuously (e.g., glued) or intermittently (e.g., stitched at certain points) along their portions that are in contact with each other as shown in FIG. 4. Similar to shin guard 100, shin guard 300 may be inverted so that sleeve 302 faces outwardly and sleeve 304 faces inwardly. This also allows for shin guard 300 to be reversible.

Figure 5:
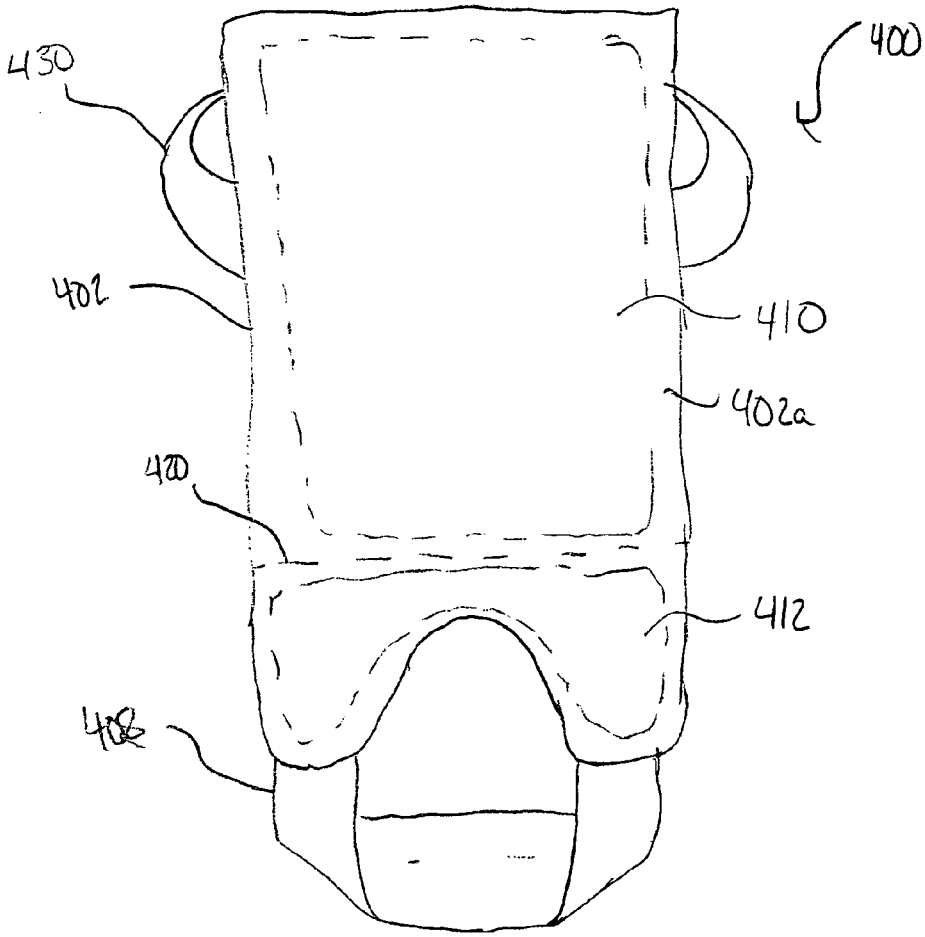
FIG. 5 is a schematic diagram that shows a front view of a second exemplary shin guard according to an embodiment of the present invention.

Another exemplary shin guard 400 is shown in FIG. 5. As can be seen, shin guard 400 is similar in many respects to shin guard 100. Shin guard 400 has two pads 410 and 412 enclosed within pad cover 402. Pad cover 402 is made of two pieces of material 402*a* and 402*b* (not shown). Each piece 402*a* and 402*b* may be made of a different color material so that shin guard 400 is also reversible. Shin guard 400 also includes a seam 420 separating pads 410 and 412 as well as a heel strap 408.

Instead of having a sleeve (such as sleeve portion 106 in FIG. 2), however, shin guard 400 includes a strap 430. Strap 430 is connected to shin guard 400 near the top of pad cover 402 and is configured to wrap around a user's calf to hold shin guard 400 in place. Strap 430 may be, for example, a hook and loop style strap or an elastic strap. Other suitable strap configurations may also be used to hold guard 400 in place. Although as depicted strap 430 is made of a single piece of material, strap 430 may comprise two pieces of material or other suitable coloring so that strap 430 matches the colors of pad cover portions 402*a* and 402*b* when in place on a user.

Guard 100 may be made, for example by attaching two pieces of material having different colors so as to make pad cover 102. Pad 110 may then be inserted into cover 102. In a similar fashion, sleeve 106 may be made of two pieces of material having different colors, from each other, but the same two colors used in cover 102. Sleeve 106 may then be affixed to pad cover 102 so that matching colors face the same way, either outwardly or inwardly. The colors used for sleeve 106 do not, however need to match those of cover 102 and could, for example, be two different, but coordinating colors, or simply be the same color so that only the pad cover has a reversible nature. Once assembled, guard 100 would have at least two colors and be capable of being reversed depending on which color is desired to face outwardly.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

The invention claimed is:

1. A reversible protective shin guard, comprising:

a pad;

a pad cover enclosing the pad, the pad cover comprising a first cover piece and a second cover piece enclosing the pad, the first cover piece and the second cover piece being separate pieces of fabric;

a sleeve portion attached to the pad cover, the sleeve portion comprising a first sleeve piece and a second sleeve piece, the first sleeve piece and the second sleeve piece being separate pieces of fabric; and a seam joining the first cover piece, the second cover piece the first sleeve piece and the second sleeve piece, the first cover piece and the first sleeve piece made of a first color, the second cover piece and the second sleeve piece made of a second color different from the first color, and the shin guard being reversible between a first configuration in which the first color is substantially facing outwardly and a second configuration in which the second color is substantially facing outwardly.

2. The protective guard of claim 1, wherein at least one of the sleeve portion and the pad cover is made of a breathable material.

3. The protective guard of claim 1, wherein the pad is free-floating within the pad cover.

4. The protective guard of claim 3, further comprising an opening in the pad cover to allow for removal of the pad.

5. The protective guard of claim 4, wherein the pad cover includes a fastener for closing the opening.

6. The protective guard of claim 5, wherein the fastener comprises a hook and loop fastener.

7. The protective guard of claim 1, further comprising a stirrup affixed to the guard.

8. The protective guard of claim 1, further comprising an elastic band affixed to the pad cover and the sleeve portion, the elastic band having a first band piece of the first color and a second band piece of the second color, wherein the first band piece faces substantially outwardly and in the first configuration and the second band piece faces substantially outwardly in the second configuration.

9. The protective guard of claim 1, wherein the pad is a first pad and the protective guard further comprises a second pad enclosed in the pad cover.

10. The protective guard of claim 9, wherein the second pad is located below the first pad when in position on a user.

11. The protective guard of claim 9, further comprising a seam between the first pad and the second pad.

12. A method for making a reversible protective shin guard comprising:

attaching a first cover piece to a second cover piece to create a pad cover, the first cover piece having a first color and the second cover piece having a second color different from the first color, wherein the first cover piece and the second cover piece are separate pieces of fabric;

inserting a pad in the pad cover; and attaching a sleeve portion to the pad cover, the sleeve portion comprising a first sleeve piece of the first color and a second sleeve piece of the second color, the first sleeve piece and the second sleeve piece being separate pieces of fabric, the sleeve portion being attached at a seam joining the first cover piece the second cover piece, the first sleeve piece and the second sleeve piece;

the protective guard shin being reversible between a first configuration in which the first color is substantially facing outwardly and a second configuration in which the second color is substantially facing outwardly.

13. The method of claim 12, further comprising removing the pad from the pad cover.

* * * * *